United States Patent [19]

Tirone et al.

[11] 4,177,367

[45] Dec. 4, 1979

[54] PUSH BUTTON SWITCH

[75] Inventors: Stephen A. Tirone, Boca Raton; Ronald H. Arthur, Lauderhill, both of Fla.

[73] Assignee: AMF Incorporated, White Plains, N.Y.

[21] Appl. No.: 925,675

[22] Filed: Jul. 18, 1978

[51] Int. Cl.[2] ..... H01H 9/00

[52] U.S. Cl. ..... 200/159 A; 200/67 DA

[58] Field of Search ..... 200/159 A, 159 R, 67 D, 200/67 DA, 314

[56] References Cited

U.S. PATENT DOCUMENTS

| | | | |
|---|---|---|---|
| 2,584,460 | 2/1952 | Jacobs | 200/67 D |
| 3,749,872 | 7/1973 | Foster | 200/166 PC |
| 3,916,131 | 10/1975 | Golbeck et al. | 200/159 A |
| 4,016,388 | 4/1977 | Golbeck et al. | 200/314 |
| 4,063,054 | 12/1977 | Hirata | 200/159 R |

*Primary Examiner*—Houston S. Bell

*Attorney, Agent, or Firm*—George W. Price; John H. Gallagher

[57] ABSTRACT

A momentary pushbutton switch has a circular actuating button with a downwardly extending center post. The post is in continuous contact with a center cantilevered leg of a spring contact member. The spring contact member also has side arms that are joined at opposite ends to respective end portions. One end portion is fixed to one terminal on a base member and the opposite end portion is free and spring biased above a stationary contact on the base. Depression of the actuaing button forces the cantilevered leg and free end downwardly toward a stop on the base. The free end then engages the stationary contact, closing the switch contacts. The base and contacts are specially formed to make assembly simple and error free.

5 Claims, 5 Drawing Figures

PUSH BUTTON SWITCH

The present invention relates to an improved push button switch that is relatively simple to manufacture, is easily assembled in a substantially foolproof manner, and is capable of carrying relatively high values of current.

The invention will be described in connection with the accompanying drawings wherein.

DETAILED DESCRIPTION OF PREFERRED EMBODIMENT

Figure 3:
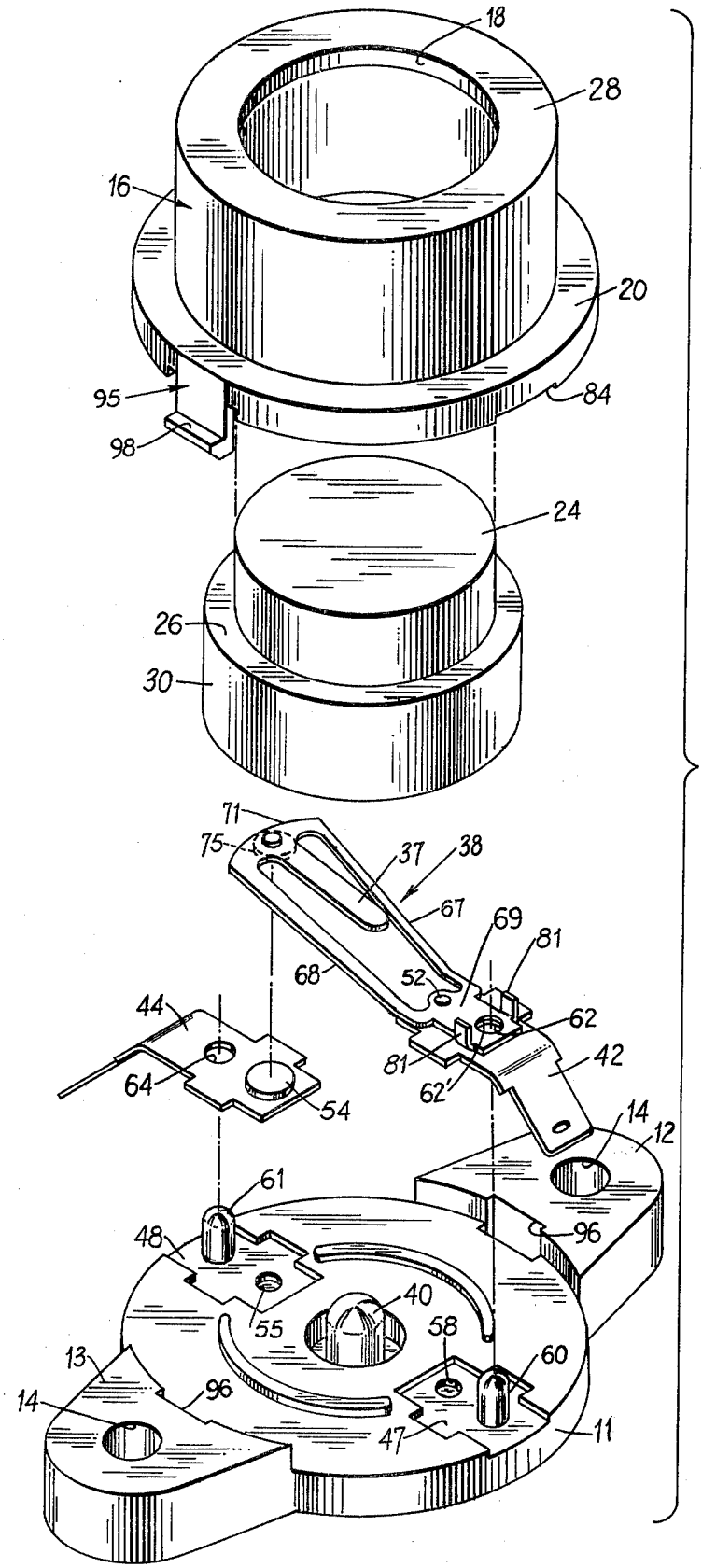
FIG. 3 is an exploded view of the switch of FIG. 1.

Push button switch 10 is comprised of a base 11 whose mid region is circular and which has oppositely extending arms 12 and 13. Base 11 is molded from a plastic material that is an electrical insulator. As best seen in FIG. 3, arms 12 and 13 are approximately twice as thick as the central circular portion of base 11. Mounting holes 14 extend through arms 12 and 13.

A hollow cylindrical housing member 16 has an open-ended top 18 and a circular rim 20 of greater diameter at its base. Rim 20 conforms to the circular portion of base 11 between arms 12 and 13.

An actuator button 24 extends upwardly through the open top 18 of housing member 16. Actuator botton 24 has a radially extending shoulder 26 that is engaged by the inwardly extending flange 28 at the top of the housing member 16, thereby to prevent the button from being withdrawn from the housing. The lower cylindrical portion 30 of actuator button 24 provides a bearing surface that engages with and slides on the inner surface of housing member 24 when the button moves up and down.

Figure 1:
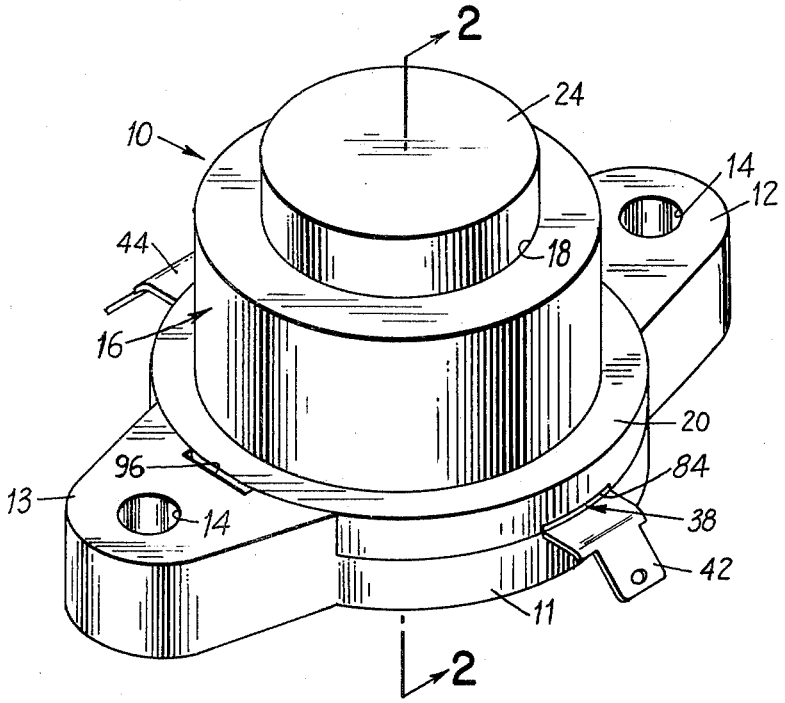
FIG. 1 is a perspective view of a push button switch of this invention.
Figure 2:
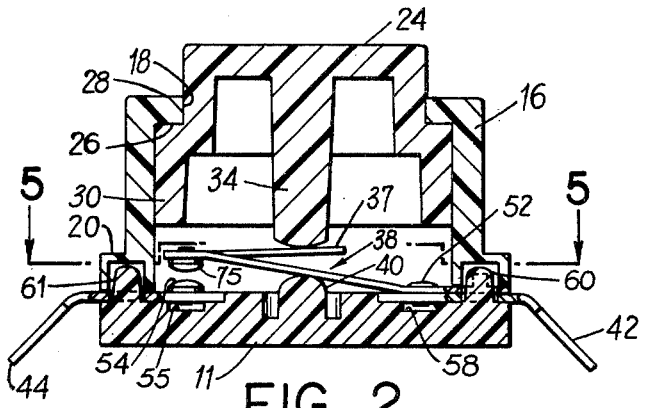
FIG. 2 is a sectional view taken through section 2—2 of FIG. 1.

An actuating post 34, FIG. 2, extends downwardly from the center of actuator button 24. The bottom tip of post 34 is in contact with the cantilevered center leg 37 of a spring member 38 that will be described in detail below.

Both the housing member 16 and actuator button 24 are molded from a plastic material that is an electrical insulator.

A short post 40 at the center of base 11 is in vertical registration with actuating post 34. The height of post 40 is chosen to limit the extent of downward travel of actuating post 34, thereby to prevent spring member 38 from being overstressed.

Electrical terminals 42 and 44 extend radially outwardly between base 11 and rim 20 at opposite sides of the switch. As best seen in FIG. 3, the interior ends of terminals 42 and 44 are flat and cruciform in shape and are located within the enclosed region of the switch. The top surface of base 11 has respective cruciform shaped recesses 47 and 48 molded therein for receiving the similarly shaped inner terminal ends, thereby to locate the terminals on base 11. Terminal 44 has a stationary contact 54 riveted to its inner end. The upset riveted shank of stationary contact 54 is received within a clearance hole 55, FIG. 2, molded within the cruciform recess on the surface of base 11.

Spring member 38 is secured to the opposite terminal 42 by a rivet 52. The upset riveted shank of rivet 52 is received within a clearance hole 58 molded within the cruciform recess 47 in which terminal 42 is received.

Upstanding projections in the form of short pins 60 and 61 are integrally molded as part of base 11, and are located in the cruciform shaped recesses 47 and 48. The terminals 42 and 44 have respective holes 62 and 64 extending through them to allow the terminals 42 and 44 to be placed over the pins 60 and 61 when the terminals are assembled onto base 11.

The cruciform recesses 47 and 48, with the respective clearance holes 58 and 55 and pins 60 and 61 are mirror images of each other with respect to a vertical plane that passes normally into the plane of the paper and through posts 34 and 40, FIG. 2. Similarly, the terminals 42 and 44 and their respective holes 62 and 64 are substantially identical to each other. Consequently, either one of the terminals 42 or 44 may be mounted on either side of base 11. This simplifies assemblying the terminals onto the base and eliminates the possibility of an erroneous interchange of terminal on the base.

Referring to FIG. 3, spring member 38 extends radially inwardly and its inner end is overlaying but vertically spaced from terminal 44. Spring member 38 is made of an electrically conductive spring metal such as beryllium copper and includes the side arms 67 and 68 that extend from its base 69. The previously mentioned cantilevered arm 37 extends radially outwardly from the far end 71 that joins the inner ends of side arms 67 and 68. A movable contact 75 is secured, as by riveting, to far end 71 of spring 38.

The base portion 69 of spring member 38 has a hole 62' in alignment with hole 62 in terminal 42 to receive pin 60 on base 11. The base portion 69 also includes a pair of upstanding projections or tabs 81 in transverse alignment with hole 62'. When terminal 42 is assembled on base 11, the top of pin 60 is approximately at the height of the tops of tabs 81.

Figure 4:
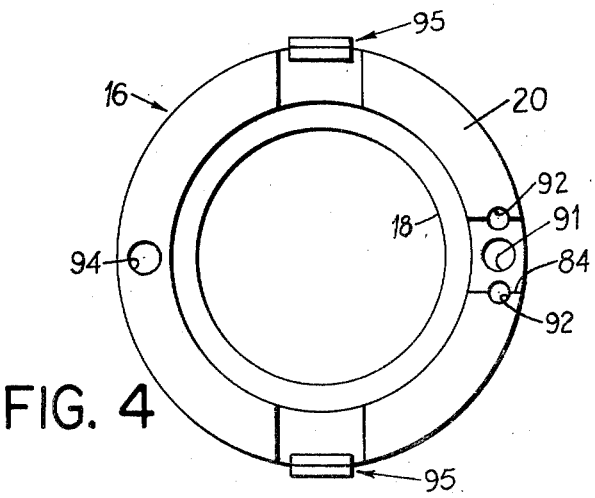
FIG. 4 is a plan view of the bottom of the housing member of the switch of FIG. 1.
Figure 5:
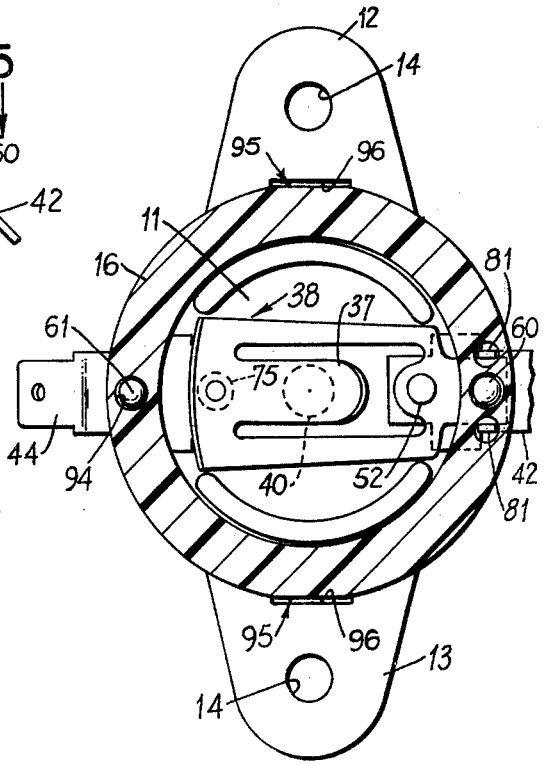
FIG. 5 is a sectional view taken at section 5—5 of FIG. 2 and showing the normally enclosed interior region of the switch of FIG. 1.

It will be seen in FIG. 3 that the bottom surface of the rim portion 20 of housing member 16 has a recess 84 that is in vertical registration with the tabs 81 and pin 60 when the housing is assembled onto base 11 with the terminal 42 thereon. Recess 84 provides clearance for the base portion 69 of spring member 38. As best seen in FIGS. 4 and 5, the bottom edge of the rim portion 20 of housing 16 has the recesses or holes 91 and the pair of holes 92 therein at the location of recess 84. These three holes receive the top end of pin 60 and the pair of tabs 81. On the opposite side of the bottom surface of housing 16 a single hole 94 is located to receive the pin 61 on base 11.

The feature of the three holes (91 and the pair 92) on one side of the bottom surface of housing member 16 and a single hole on the opposite side is an aid to the human assembler to assure that the recess 84 on the bottom surface of the housing is placed on the side of base 11 where the increased thickness of spring 38 and terminal 42 is located.

The cruciform recesses 47 and 48 in base 11 are molded deep enough that the top surfaces of terminals 42 and 44 are substantially flush with the top surface of base 11. Therefore, the base portion 69 of spring 38 extends above the top surface of base 11. Were it not for the recess 84 in the bottom of housing member 16, base portion 69 would interfere with the bottom surface of housing member 16 sitting flush on the surface of base 11 throughout the circumference of bottom rim 20.

The two tabs 81 on base portion 69 serve two functions. First, they serve as a key to prevent the housing 16 from being assembled onto base 11, 180 degrees from its correct position. That is, tabs 81 will prevent housing member 16 from seating down squarely onto base 11 if it is attempted to be assembled incorrectly. The human assembler not only can visually discern the correct relationship between the holes and the pin and tabs, but also can feel that the housing member 16 will not fit evenly onto base 11. Secondly, the tabs 81 engaging the holes 92 in the bottom surface of housing 16 anchors the spring member 38 and prevents it from pivoting about the rivet that secures it to terminal 42. This assures that movable contact 75 maintains its proper relationship immediately above stationary contact 54.

Housing member 16 is maintained in tight engagement with base 11 by means of a pair of oppositely located latching means 95, FIG. 3, that are molded as an integral part of housing means 16. The latching means 95 are a pair of downwardly extending barbed or hooked elements that are received within aligned receptacles 96 in base 11. The hooked portion 98 of latching means 95 snaps under an edge in the receptacles 96 to firmly hold the housing 16 onto base 11. The plastic latching means 95 are sufficiently yielding to permit them to be deflected enough for the hooked portions 98 to disengage from the ledges in receptacles 96, thereby allowing easy removal of the housing from the base.

The fact that spring member 38 and terminal 42 are separate pieces rather than one piece provides several advantages. The optimum material and design may be selected for each function (terminal, and spring) without regard to the other. Furthermore, switches rated for different current carrying capacities may be provided by varying the dimensions of the side arms 67 and 68 of spring member 38. The electrical capabilities of this switch may also be tailored to suit different applications by varying the thickness of spring member 38, terminals 42 and 44, and the size and composition of contact rivets 54 and 75.

To assemble the switch of this invention, terminal 44 is placed onto base 11 with one of the pins 61 or 60 extending through hole 64, and with contact 54 on top. The cruciform shape of the inner end of contact 44 fits snugly within one of the cruciform recesses 48 or 47 in the base. Contact 42 then is inserted onto the other side of base 11 with the other pin 60 or 61 extending through the hole 62. The cruciform shaped inner end of contact 42 is located in the other cruciform recess 47 or 48 in base 11. As mentioned above, either terminal will fit on either side of base 11. It will be noted that upstanding tabs 81 will prevent the inner end of terminal 42 from seating flush within the cruciform recess 47, FIG. 3. This is a further aid to the assembler to assure that the terminal is assembled correctly.

With terminals 42 and 44 correctly assembled as described, movable contact 75 is directly above and spaced from stationary contact 54.

Next, the top end of actuator button 24 is inserted through the open end of housing member 16. Housing member 16 and actuator button 24 then are positioned so that the latching means 95 align with the respective latch receptacles 96, and the holes 91 and 92 in the bottom edge of the housing member are in registration with the pin 60 on base 11 and tabs 81 on spring 38. The housing member then is pushed downwardly so that the latching means 95 latch into the receptacles 96. The switch now is completely assembled and the center actuating post 34, FIG. 2, is in contact with the cantilevered arm 37 of spring 38. The resiliency of the spring 38 keeps actuating button 24 in its outermost position.

To operate the switch, actuator button 54 is pressed inwardly and center actuating post 34 pushes cantilevered arm 37 downwardly. After a predetermined distance of downward movement of arm 37, the innermost end of spring 38 moves down sufficiently to bring movable contact 75 into engagement with stationary contact 54, thereby closing the switch. Further downward overtravel of actuator button 54 is accommodated by further deflection of cantilevered arm 37 until arm 37 comes into contact with base projection 40. This overtravel motion produces some slight wiping action of contact 75 against terminal contact 54. This provides useful cleansing action which tends to break through surface tarnish films on the contacts and helps to maintain low electrical contact resistance. Removal of the downwardly applied force to button 24 allows spring member 38 to return to the position illustrated in FIG. 2, thereby allowing the contacts 54 and 75 to separate.

Wiping action between the separating contacts provides a shearing effect which tends to overcome any welding at the contact interface.

In its presently preferred embodiment, spring member 38 is not a snap type spring, although it could be if so desired.

While a preferred embodiment of the invention has been illustrated and described, it is to be understood that alterations and modifications may be made to the described embodiment without departing from the scope of the present invention.

What is claimed is:

1. A push button switch comprising a base of electrical insulating material, a hollow cylindrical housing of electrical insulating material having an open bottom, latching means extending from the bottom of said housing, means in said base for releasably receiving said latching means for holding the housing in contact with the base, thereby to provide an enclosed region between the base and housing, first and second substantially identical electrical terminals extending laterally from the interior to the exterior of said enclosed region at respective spaced locations about said housing, first and second recesses in the top surface of said base proximate said spaced locations, said recesses being complementary in shape to the interior portions of said terminals for receiving respective ones of said terminal portions therein, first and second projections extending upwardly from the surface of said base at the respective locations where the two terminals are located and in registration with the bottom edge of the housing, an aperture in each of said terminals for receiving a respective one of said projections, thereby to locate said terminals on said base, an elongated spring member of electrical conducting material having an aperture at one end in engagement with a respective one of said projections and in engagement with a respective one of said terminals, said spring member extending inwardly within a said enclosed region and having its inner end overlaying but spaced from said first terminal, first and second contacts respectively secured to said first terminal and said spring member and located to engage each other when the spring member is moved toward the first terminal, one or more tabs extending upwardly from the end of said spring member that engages a respective projection, first and second recesses in the bottom edge of said housing for receiving respective ones of said projections, additional recesses in the bottom edge of the housing for receiving said one or more tabs and for providing clearance for said first end of the spring member, actuator means on said housing member for engaging the spring member to move the second contact into engagement with the first contact, said spring member urging the actuator away from the first terminal in the absence of a force being applied to the actuator.

2. The combination claimed in claim 1 and including stop means extending from the top surface of said base, said stop means being in registration with said spring member to stop the travel of the spring member after it has traveled a given distance, thereby to prevent overstressing of the spring member.

3. A push button switch comprising a base of electrical insulating material, a hollow cylindrical housing member of electrical insulating material having an open bottom and an open top, latching means extending from the bottom of said housing member, means in said base for releasably receiving said latching means for holding said housing member in contact with said base, thereby to provide an enclosed region between the base and housing member, a first electrical terminal extending laterally from the interior to the exterior of said enclosed region, the top surface of the base having a recess therein complementary in shape to the interior portion of said terminal for receiving said terminal portion therein, the interior portions of the two terminals being flush with the top surface of the base and passing between the base and housing member to the exterior of the enclosed region, an elongated spring member of electrical conducting material secured at or near a first one of its ends to said second electrical terminal, the other end of the spring member extending inwardly within said enclosed region and spaced above the top surface of the base, a second electrical contact on said spring member at a position within the enclosed region to engage said first contact upon movement of the spring member toward said first terminal, an actuator button extending through the open top of the housing member and adapted to reciprocate with respect thereto, means for preventing the withdrawal of the actuator button through said open top of the housing member, actuating means on said button contacting said elongated spring member and adapted to move said second electrical contact into engagement with the first contact when the button is moved inwardly, said spring member urging said button to its outermost position and thereby permitting separation of said contacts when no inwardly directed force is applied to said button, first and second projections extending upwardly from the surface of said base at the respective regions where said two terminals are located in registration with the bottom edge of the housing member, an aperture in each of said terminals for receiving a respective one of said projections, thereby to locate said terminals on said base, first and second spaced recesses in the bottom edge of said housing member for receiving respective ones of said projections when the housing member and base are assembled in contact with each other, first end of the spring member extending radially outwardly along said second terminal beyond the respective projection and having an aperture therein for permitting the projection to pass therethrough, one or more tabs extending upwardly from said first end of the spring member at a location in registration with the bottom edge of the housing member in an assembled switch, recesses in the bottom edge of said housing member for receiving said tabs, a further recess in the bottom edge of the housing member in the region of said tab receiving recesses for accommodating the thickness of the first end of the spring member, thereby to permit the bottom edge of the housing member to firmly contact the top surface of the base in the region proximate said second terminal.

4. A push button switch comprising a base of electrical insulating material, a cylindrical housing member of electrical insulating material having an open bottom and an open top, latching means extending from the bottom of said housing member, means in said base for releasably receiving said latching means for holding said housing member in contact with said base, thereby to provide an enclosed region between the base and housing member, a first electrical terminal secured between said base and housing member and having one end extending inwardly within said enclosed region and a second end extending outwardly from said base and housing member, a first electrical contact on said first terminal in said enclosed region, a second electrical terminal secured between said base and housing member at a location spaced from said first terminal and having an end exterior of said housing, an elongated spring member of electrical conductive material secured near a first one of its ends to said second electrical terminal at a region radially inwardly of the location where said housing member contacts said base, the other end of said spring member extending inwardly within said enclosed region, said first end of the spring member extending in overlaying relationship with the second terminal in the region of the bottom edge of the housing member, a second electrical contact on said spring member at a position within said enclosed region to engage said first contact, an actuator button extending through the open top of the housing member and adapted to reciprocate with respect thereto, means for preventing the withdrawal of the actuator button through said open top of the housing member, actuator means on said button contacting said elongated spring member and adapted to move said second electrical contact into engagement with the first contact when the button is moved inwardly, said spring member urging said button to its outermost position and thereby permitting separation of said contacts when no inwardly directed force is applied to said button, first and second projections extending upwardly from the surface of said base at the respective regions where said two terminals are located and in registration with the bottom edge of the housing member, first and second spaced recesses in the bottom edge of said housing member for receiving said respective projections on the base when the housing member and base are assembled in contact with each other, an aperture in each of said terminals and in said first end of the spring member for receiving a respective one of said projections, thereby to locate said terminals on said base, one or more tabs extending upwardly from said first end of the spring member at a location in registration with the bottom edge of the housing member in an assembled switch, recesses in the bottom edge of said housing member for receiving said tabs, a further recess in the bottom edge of the housing member in the region of said tab receiving recesses for accommodating the thickness of the first end of the spring member, thereby to permit the bottom edge of the housing member to firmly contact the top surface of the base in the region proximate said second terminal.

5. The push button switch claimed in claim 3 or 4 including stop means extending from the top surface of said base, said stop means positioned under said spring member to limit the travel of the spring member to a predetermined distance, thereby to prevent overstressing of the spring member.

* * * * *

UNITED STATES PATENT AND TRADEMARK OFFICE

CERTIFICATE OF CORRECTION

PATENT NO. : 4,177,367

DATED : December 4, 1979

INVENTOR(S) : Stephen A. Tirone et al.

It is certified that error appears in the above—identified patent and that said Letters Patent is hereby corrected as shown below:

Column 6, Claim 3, line 11, after "located" insert

-- and --.

Signed and Sealed this

*Fifteenth* Day of *April 1980*

[SEAL]

*Attest:*

SIDNEY A. DIAMOND

*Attesting Officer*

*Commissioner of Patents and Trademarks*